United States Patent [19]

Pettigrew

[11] 4,448,339

[45] May 15, 1984

[54] NAIL DRIVING AND RECESSING TOOL

[76] Inventor: Ronald Pettigrew, 42 Tennyson Ave., Westbury, N.Y. 11590

[21] Appl. No.: 327,237

[22] Filed: Dec. 3, 1981

[51] Int. Cl.[3] ..... B25C 7/00

[52] U.S. Cl. ..... 227/147

[58] Field of Search ..... 227/147

[56] References Cited

U.S. PATENT DOCUMENTS

| | | | |
|---|---|---|---|
| 225,482 | 3/1880 | Mower | 227/147 X |
| 1,289,526 | 12/1918 | Nye . | |
| 1,512,134 | 10/1924 | Racett | 227/147 X |
| 2,472,353 | 6/1949 | Van Sittert et al. . | |
| 2,543,942 | 3/1951 | Shaff . | |
| 2,671,216 | 3/1934 | Fox . | |
| 2,787,178 | 4/1937 | Maxim . | |
| 2,931,041 | 4/1960 | Kennell . | |
| 3,042,004 | 7/1962 | Fischer et al. . | |
| 3,112,488 | 12/1963 | Detloff et al. | 227/147 X |
| 3,602,419 | 8/1971 | Doverne et al. | 227/147 |

*Primary Examiner*—E. R. Kazenske
*Assistant Examiner*—Douglas D. Watts
*Attorney, Agent, or Firm*—Albert F. Kronman

[57] ABSTRACT

A nail driving and recessing tool for use with percussive equipment in which the nail driving end of an elongated shaft, the opposite end of which is coupled to the percussive equipment, has an elongated sleeve yieldably carried there around and capable of limited axial movement with respect to the shaft. Suitable stops are provided on the shaft and sleeve so that the shaft can continue to drive the nail below the surface of a work piece for a predetermined limited distance to recess the nail head below the surface.

4 Claims, 4 Drawing Figures

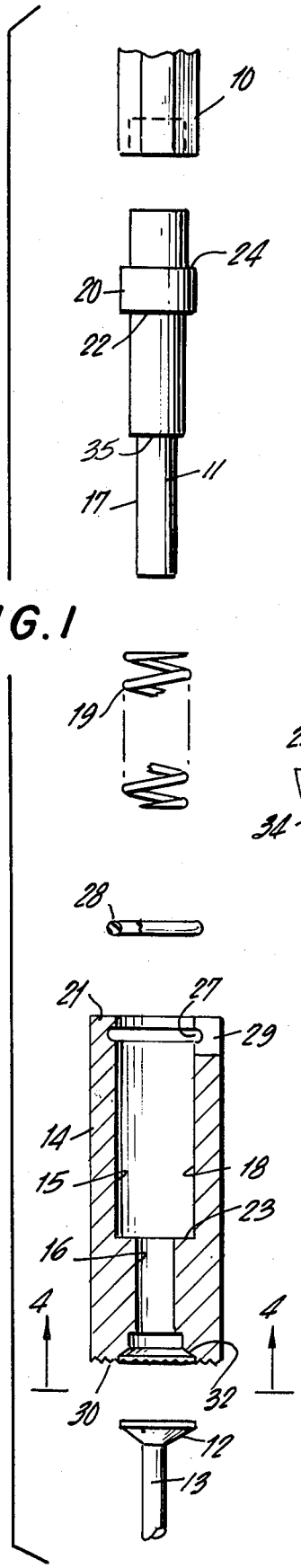
FIG. 1
FIG. 2
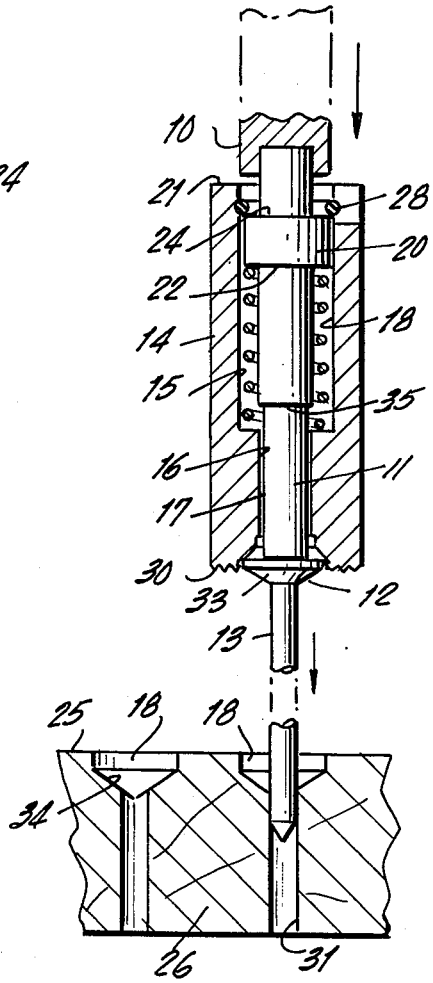
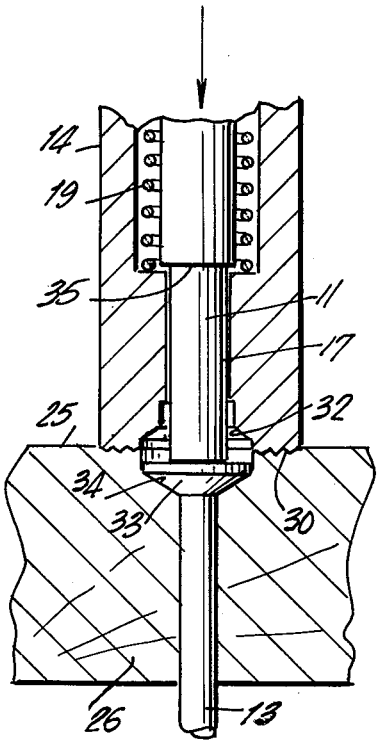
FIG. 3
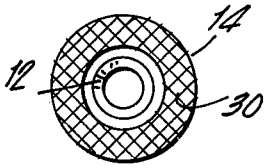
FIG. 4

NAIL DRIVING AND RECESSING TOOL

PRIOR ART STATEMENT

In connection with the application filed this 30th day of November 1981, applicant herewith encloses copies of the following patents in compliance with Rules 1.97–1.99.

A. U.S. Pat. No. 1,289,526 H. R. Nye 12/31/18
B. U.S. Pat. No. 3,042,004 H. R. Fischer 7/03/62
C. U.S. Pat. No. 2,472,353 P. Van Sittert 6/07/49
D. U.S. Pat. No. 2,543,942 E. H. Shaff 3/06/51
E. U.S. Pat. No. 2,671,216 M. H. Fox 3/09/54
F. U.S. Pat. No. 2,787,178 G. Maxim 4/02/57
G. U.S. Pat. No. 2,931,041 E. D. Kennel 4/05/60
H. U.S. Pat. No. 3,602,419 M. Doberne 8/31/71

RELEVANCE OF THE LISTED ITEMS

"A" discloses a rivet setter for upsetting the ends of rivets.

"B" is directed to a nail driving attachment but only discloses driving a nail with the nail head flush with the surface of the wood.

"C" is a nailing attachment which only drives the nails flush with the wood.

"D" is a nail driver which can not recess the nail heads.

"E" is a nail holding device for pneumatic hammer tools.

"F" is another rivet set which can not recess nail heads.

"G" is a nail set primarily concerned with holding the tool centered on the nail.

"H" is a device for driving nails into concrete. There is no suggestion of recessing the nail heads.

BACKGROUND OF THE INVENTION

Where heavy wood construction is required such as on the planking of boardwalks, docks, walkways, ramps and the like, the specification for the job frequently requires that the planks be nailed in such manner that the nail heads are recessed below the surface of the planks. The recessing is desirable to prevent accidents when people walk across the structure should the nail heads work their way out so as to protrude above the surface of the planking.

Planking for heavy duty use is usually made of very dense wood known in the industry as "green hard lumber." Such lumber presents great difficulty when nails or spikes have to be driven through it. As a consequence, pneumatic hammers are employed to drive the nails through pre-drilled bores which are of a diameter slightly smaller than the diameter of the nails or spikes. The pre-drilled bores are thereafter countersunk by means of a suitable cutting tool to receive the head as it is recessed below the surface of the plank.

In the present state of the art the nails are driven into the bores until the head of the nail is flush with the surface of the plank. Thereafter, the nail heads are recessed manually by workmen using a drive pin and a hammer to force the nail against the bottom of the countersunk portion of the bore. This recessing operation is extremely time consuming and, therefore, adds substantially to the cost of construction.

Accordingly, it is an object of the present invention to provide a nail or spike recessing device which can drive the said spike to a position within a countersunk hole rapidly and accurately. Another object of the present invention is to provide a nail recessing device which is compatible with presently known pneumatic hammers or similar nail driving mechanisms. A further object of the present invention is to provide a nail recessing device which can be quickly removed for repair or replacement without costly interruption of the nailing operation.

SUMMARY OF THE INVENTION

A nail driving and recessing device according to the present invention consists of an elongated driving shank for attachment to an air hammer or similar device, said shank terminating in a nail head receiving surface. A heavy sleeve open at each end slides longitudinally upon the nail receiving portion of the shank. The sleeve is spring loaded so that after the end of the sleeve reaches the surface of the plank being nailed, the end of the shank can continue for the desired nail recessing depth without driving the sleeve beyond the surface of the plank.

BRIEF DESCRIPTION OF THE DRAWINGS

In the accompanying drawing forming part hereof similar elements have been give the same reference numerals, in which drawing:

FIG. 1 is a somewhat exploded partially broken away view of a complete embodiment of the present invention.

FIG. 2 is a view similar to FIG. 1 showing the nail driving and recessing device in its assembled condition at the start of the nail driving operation.

FIG. 3 is a somewhat enlarged view of the driving end of the device shown in FIG. 2 at the end of the recessing step.

FIG. 4 is an end view taken on line 4—4 of FIG. 1 looking in the direction of the arrows.

DETAILED DESCRIPTION

Referring to the drawing and particularly to FIGS. 1–3, there is shown a steel driving shank 10 formed of suitably tempered material, well-known in the art which is insertable in a pneumatic hammer (not shown). An elongated nail driving and recessing shaft 11 is carried in the end of the shank 10 or may be formed integral therewith. The end of the nail driving shaft 11 is provided with a flat surface suitable for applying a hammering action to the head 12 of a nail or spike 13.

An elongated sleeve 14 having a two diameter bore 15 therein is freely received upon the nail driving end of the shaft 11. The smaller diameter bore 16 of the sleeve 14 is of a size to freely receive a reduced portion 17 of the shaft 11. The larger diameter bore 18 of the two diameter bore 15 is sufficiently large to receive elongated shaft 11 and a coil spring 19 which is disposed about the shaft 11 within the large diameter bore.

Inwardly spaced from the upper end 21 of the sleeve 14, the driving shaft 11 is formed with a boss 20. The bore 20 is provided with a bottom shoulder 22 and a top shoulder 24. The bottom shoulder 22 receives the upper end of the coil spring 19 and serves as a stop for said spring. Shoulder 23 in the bottom of the bore 15 formed where the small diameter portion and the larger diameter portion meet receives the lower end of the coil spring 19. It will be observed from an examination of FIG. 2, that the coil spring is in its extended state at the beginning of the nail driving operation and becomes compressed when the sleeve 14 comes into contact with the surface 25 of the plank 26 as shown in FIG. 3.

An annular recess 27 is machined into the larger bore wall of the sleeve 14 as best shown in FIG. 1. The annular recess 27 is of a dimension to receive a ring 28 which may be a snap ring or the neoprene (synthetic rubber), "0" ring shown in FIG. 2. The ring 28, when in place, overlies the top shoulder 24 of the boss 20, thereby holding the parts of the nail driving and recessing device in their assembled condition. Easy disassembly of the device for repair is accomplished by inserting a small tool (not shown) into the recess 29 at the top of the sleeve 14 and forcing the ring 28 out of the recess 27.

It may be desirable in certain applications to prevent the sleeve 14 as it comes to bear against the surface 25 of the plank 26 from bouncing around on said surface. Such action might move the driving shaft 11 out of registration with the nail head 12. Accordingly, a roughened lower surface 30 (best shown in FIG. 4) is machined into the bottom of the sleeve 14. The roughened surface may consist of small teeth, grooves or any suitable slip resisting configuration.

The operation of the nail driving and recessing device will become apparent from the foregoing as follows:

After the planks 26 have been properly bored and countersunk the nails 13 are lightly tapped into the pre-drilled bores 31. With the nail driving and recessing device secured within the pneumatic hammer, the head 12 of the nail is engaged by a tapered opening 32 in the end of the sleeve 14. The taper of the opening 32 serves to center the nail within said opening. The pneumatic hammer is then started causing the nail driving shaft to apply driving force to the nail head 12 as shown in FIG. 2. When the nail has been driven into the bore 31, a distance which will bring the top of the nail head flush with the surface 25 of the plank, the bottom of the sleeve 14 will come in contact with the surface 25 of the plank 26. Continued application of the hammering force will then push the driving shaft 11 downwardly, compressing the coil spring 19, until the nail head is recessed for the desired depth within the countersunk portion of the bore. The nail may be made with a beveled head as indicated at 33 so that it will seat on the bevel of the counterbore 34. The driving operation can then be stopped. In addition, the distance between the shoulder 35 on the nail driving shaft formed by the reduced portion 17 of said shaft can be machined so that the shoulder 35 will stop against the bottom of the larger portion of the two diameter bore 15, as shown in FIG. 3, and thereby regulate the amount that the nail head will be recessed into the plank 26.

Having thus fully described the invention what is desired to be claimed by Letters Patent is:

1. A nail driving and recessing tool for use with percussive equipment upon a predrilled and recessed work piece comprising an elongated nail driving shaft operatively engagable with said percussive equipment at one end, a nail driving portion on the other end of the shaft, a first and a second diameter portion on said shaft, said second diameter portion being smaller than the first diameter portion and forming the said nail driving portion, a sleeve slidably carried by the two-diameter nail driving shaft, a stepped elongated axial bore in said sleeve to receive the said shaft, a first large diameter portion of the bore being of a size to freely receive the larger diameter portion of the shaft, a second smaller diameter portion of the bore of a size to slidably receive the smaller diameter portion of the shaft therethrough to guide the nail driving portion of the second diameter portion of the shaft, said smaller diameter portion of the shaft being of a length to permit the smaller diameter shaft portion to advance beyond the sleeve and drive a nail into the recessed portion of the work piece and below the surface of said work piece, a spring carried within the large diameter portion of the bore and around the first diameter portion of the shaft to yieldably urge the sleeve in the direction of the work piece until the sleeve comes to bear against the surface of said work piece, and a third tapered, portion of the stepped bore in the sleeve at the nail driving end of the tool, said third diameter portion being of a size to engage and center the head of the nail to be driven when the nail head is located well above the surface of the work piece.

2. A device according to claim 1 in which a boss is formed on the larger portion of the shaft and the spring is a coil spring disposed around the shaft within the large diameter of the sleeve bore.

3. A device according to claim 2 in which the stepped bore in the sleeve forms a shoulder between the first and second bores and the coil spring is supported between the boss and the said shoulder.

4. A device according to claim 2 in which the sleeve is provided with an annular recess having a lateral opening therein spaced from the upper end of said sleeve and adjacent the top of the boss and a retaining ring is received in said recess overlying the boss to limit the travel of the sleeve in the direction of the nail driving portion of the shaft.

* * * * *